United States Patent [19]

Schram

[11] Patent Number: 4,941,135

[45] Date of Patent: Jul. 10, 1990

[54] ULTRASONIC FIELD GENERATING DEVICE

[75] Inventor: Cornelius J. Schram, Pavenham, England

[73] Assignee: National Research Development Corporation, London, England

[21] Appl. No.: 348,189

[22] Filed: May 8, 1989

Related U.S. Application Data

[63] Continuation of Ser. No. 153,832, filed as PCT GB 87/00364 on May 27, 1987, published as WO87/07421 on Dec. 3, 1987, abandoned.

[30] Foreign Application Priority Data

May 27, 1986 [GB] United Kingdom ..... 8612760

[51] Int. Cl.[5] ..... B03B 1/00; H04R 17/00

[52] U.S. Cl. ..... 367/150; 210/748; 209/155; 367/140

[58] Field of Search ..... 73/596; 209/1, 155; 210/748; 367/140, 150, 141, 142

[56] References Cited

U.S. PATENT DOCUMENTS

| | | | |
|---|---|---|---|
| Re. 32,062 | 1/1986 | Samodovitz | 367/150 |
| 3,397,936 | 8/1968 | Frayne et al. | 350/358 |
| 4,218,921 | 8/1980 | Oran et al. | 73/505 |
| 4,280,823 | 7/1981 | Szonntagh | 55/15 |
| 4,423,637 | 1/1984 | Soloway | 310/335 |
| 4,445,380 | 5/1984 | Kaminski | 367/150 |
| 4,480,324 | 10/1984 | Sternberg | 367/150 |

FOREIGN PATENT DOCUMENTS 8501892 5/1985 PCT Int'l Appl. .

OTHER PUBLICATIONS

Review of Scientific Instruments, vol. 53, No. 6, Jun. 1982, American Institute of Physics, (New York, U.S.), M. C. Lee et al.: "Acoustic Levitating Apparatus for Submillimeter Samples", pp. 854–859, see p. 854, col. 1, line 1–p. 855, col. 1, line 2; p. 858, col. 1, lines 13–19,; p. 859, col. 1, line 17–col. 2, line 3; FIG. 1.

*Primary Examiner*—Charles T. Jordan
*Assistant Examiner*—J. Woodrow Eldred
*Attorney, Agent, or Firm*—Cushman, Darby & Cushman

[57] ABSTRACT

A liquid column (2) is placed between two high-frequency ultrasound sources (6) in the field of a standing wave produced by the sources. Each source produces a convergent beam that compensates for a substantial part of the attenuation of the ultrasound energy that occurs at higher frequencies. It is thereby possible to increase considerably the axial distance along the standing wave over which streaming effects due to acoustic pressure are absent or negligible. It is also possible to increase the angle of convergence to compensate for divergence of the outputs from the sources.

12 Claims, 1 Drawing Sheet

ULTRASONIC FIELD GENERATING DEVICE

This is a continuation of application Ser. No. 07/153,832, filed as PCT OB87/00364 on May 27, 1987, published as WO87/07421 on Dec. 3, 1987, now abandoned.

BACKGROUND OF THE INVENTION

This invention relates to the generation of ultrasonic fields. It is particularly, but not necessarily exclusively, concerned with the generation of such fields for use in the manipulation of particulate matter in a fluid medium, including the removal of particles from a liquid suspension and the segregation of dissimilar particles from a mixture of particles.

Acoustic energy sources have been used to generate progressive and standing waves for a variety of purposes. For example, ultrasonic energy can have an influence on the behaviour of particles suspended in fluids, it being known that particles can be attracted to the nodes of a standing ultrasonic wave. In essence, the attracted particles become concentrated in planes lying normal to the axis of propagation of the standing wave. If the wave is moved along the axis of propagation, the particles can then carried through the fluid while they remain attached to the standing wave.

The detailed theory underlying the observed phenomenon of standing waves and their effect on particles is not fully understood. For example, the factors influencing whether any given particle type tends to accumulate at the "nodes" or at the "antinodes" of a standing wave are unclear. However, this lack of theoretical understanding has no bearing on the practical application of the present invention, and in this specification the terms "nodes" and "nodal planes" are used to include both nodes and antinodes.

When energy is propagated from an ultrasound source through a fluid, the energy level at any point in the fluid will decrease with increasing distance from the source because of attenuation by the fluid. Divergence of the beam accentuates this effect. The acoustic energy propagated by that source is therefore subject to an energy density gradient which is experienced by the fluid as a uni-directional force, in effect a radiation pressure, Such a force can cause the fluid to move away from the radiation source, this movement being referred to herein as acoustic streaming.

If acoustic energy is to be used to control the movement of particles in a volume of fluid, it is more usually the case that a standing wave is employed. Should the stading wave be formed by a normal reflection of ultrasound radiation from a single source, as in the example of U.S. Pat. No. 4280823, it will be apparent that both attenuation and divergence of the acoustic beams will give rise to a radiation pressure throughout the field of the standing wave. The resulting acoustic streaming clearly can have a disturbing effect on any attempt to control the movement of the particles by means of the acoustic forces acting directly on them, and especially if reliance is placed on the acoustic forces to discriminate between different particle types.

By using two opposed ultrasonic transducers to establish a standing wave by the interference between their outputs, it is possible to balance out radiation pressure, at least in substance, although over only a minor part of the distance between the sources at the higher ultrasonic frequency ranges suitable for processing small particles. Thus, for a standing wave in water at 20° C., the following Table shows the total working distance available in mm within three different tolerance levels of imbalance for different frequencies, ignoring the effects of divergence:

TABLE 1

| | Total working distance available (mm) Percent imbalance | | |
|---|---|---|---|
| Frequency MHz | 5% | 2% | 1% |
| 0.3 | 11,400 | 4,400 | 2,200 |
| 1.0 | 1,000 | 400 | 200 |
| 3.0 | 114 | 44 | 22 |
| 10.0 | 10.3 | 4.0 | 2.0 |

Clearly, it would be desirable to avoid generating radiation pressure within the liquid, or at least to keep such pressures sufficiently low to prevent any significant acoustic streaming, in order to have the maximum volume of the acoustic field available for particle manipulation, such as a separation process. This would dictate the use of very low frequencies because, as the table shows, the working distance can be increased considerably. However, high frequencies provide a more efficient separation process in that particles then adhere more firmly to the nodes. It is an object of the present invention to mitigate the problem posed by the streaming phenomenon and permit effective use of high frequencies.

SUMMARY OF THE INVENTION

According to one aspect of the present invention there is provided a method of rendering more uniform the energy density of an acoustic field generated by an ultrasonic source wherein the output from the source is caused to form a convergent beam having an angle of convergence sufficiently great to at least substantially compensate for attenuation of the acoustic energy in the fluid medium through which the beam is propagated.

The invention can also provide an apparatus for generating an acoustic field, comprising an acoustic energy source and a container for a volume of fluid in which the output from the source generates an acoustic field, and means for causing the acoustic energy output to form a convergent beam having an angle of convergence sufficiently great to at least substantially compensate for attenuation of the acoustic energy in the fluid medium through which the beam is to be propagated.

It will be understood that in the use of the method, the convergence applied to the ultrasonic beam should also be made to compensate for the normal divergence of the output from an ultrasonic source, although divergence is a second order effect as compared with attenuation at high frequencies.

By these means it is thus possible to create a standing wave in an acoustic field in the MHz range in which there is no or negligible acoustic streaming over a considerable axial distance, with the result that a much greater working volume can be made available for such operation as the separation or discrimination of different types of particles suspended in the fluid medium.

DETAILED DESCRIPTION OF THE PREFERRED EMBODIMENTS

The following example illustrates the use of the invention to mitigate the attenuation of an ultrasonic beam in water. In this medium at 20°, the attenuation A is given by the formula:

$$A = 25 \times 10^{-17} \times f^2$$

where f is the ultrasound frequency in MHz.

Thus, at 8 MHz, A=0.016.

If the energy densities at two points along the axis of propagation of the beam spaced d cms apart are $I_a$ and $I_b$, then the attenuation over that distance is given by the formula:

$$A = \frac{1}{2d} \log_e \frac{I_a}{I_b}$$

The attenuation, it will be noted, is a logarithmic function. To compensate for it with a convergent cone-like beam, i.e. in which the change of energy flux area varies with the square of distance, does not give a direct match. It is posible, nevertheless, to produce a rate of change of energy flux area that, over a significant axial length, approximates closely to the rate of energy loss due to attenuation, so that an effective balance is obtained over a finite distance.

Assuming a working distance of 10 cm is required, then in order to balance the energy loss due to attenuation with the gain due to convergence (and ignoring any normal divergence of the beam):

$$\log_e\left(\frac{I_a}{I_b}\right) = 20 \times 0.016$$

$$\text{whence } \frac{I_a}{I_b} = 1.377$$

If therefore a converging conical beam is established through which a cross-section normal to the axis of propagation at points 10 cm apart along that axis is in the ratio of 1.377:1, the resultant acoustic energy density will be substantially independent of position between the two points.

This corresponds to a conical angle of convergence of approximately 2°, and it is possible to establish similarly the corresponding angle for different frequencies in the same fluid medium, as follows:

TABLE 2

| MHz | ⊖° (in water at 20 C.) |
|---|---|
| 5 | 0.37 |
| 8 | 1.0 |
| 15 | 4.3 |
| 20 | 9.8 |
| 25 | 20.6 |
| 30 | 40 |

Although the usefulness of the procedure is more limited as frequency increases, because of the increasing angle of convergence, it can the seen that a valuable improvement in performance can be obtained at least up to the 25 MHz frequency.

By reducing or avoiding acoustic pressures over a longer axial distance, it is thus possible to establish very large arrays of nodal planes having constant energy density. For example, at 10 MHz in water at 20° C. there are 1350 nodes in 100 mm in the axial direction. Alternatively, convergent beams reducing or eliminating acoustic streaming in the axial direction can be used to allow the use higher frequencies (albeit over shorter distances) than would otherwise be possible.

The method of producing convergent ultrasonic beams can be by employing shaped, i.e. concave, transducer emitting surfaces, or by placing acoustic lenses in the path of transmission from the energy source. These two alternatives are illustrated schematically in FIGS. 1 and 2, respectively, of the accompanying drawings.

Figure 1:
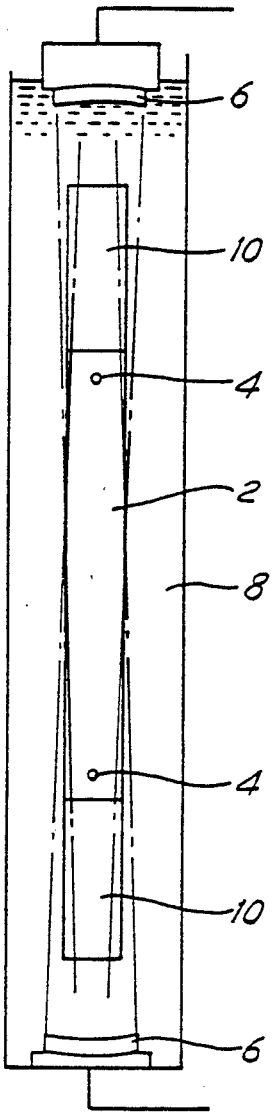
FIG. 1 represents a working column filled with liquid having particles to be manipulated by an ultrasonic standing wave in accordance with the invention.

In FIG. 1 a working colum 2 filled with liquid has inlet and outlet ports 4 for particles to be manipulated by an ultrasonic standing wave in the column while suspended in the liquid. Deatails of the manner of manipulation form no part of the present invention and will not be further described here. The standing wave is produced by opposed transducers 6 located coaxially beyond opposite ends of the column and having matched outputs. The column and the transducers are immersed in a liquid bath 8 which couples the transducer outputs to the liquid in the column while the bath is isolated from the column by liquid-tight seals 10. The walls of the column 2 and the seals 10 are acoustically transparent.

Each transducer has concave radiating face and so produces a convergent beam of ultrasonic energy having a constant energy density along its length, as described above. Consequently, the interference of the two beams produces a standing wave free of any significant degree of acoustic streaming over a substantial working length within the column.

Figure 2:
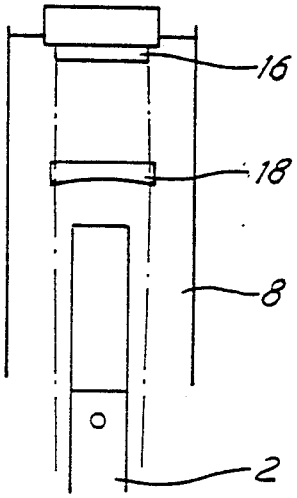
FIG. 2 illustrates an embodiment in which a planar radiating surface is provided on the transducer.

FIG. 2 illustrates one end of a similar arrangement in which, however, a planar radiating surface is provided on the transducer 16. Between it and the adjacent end of the column an acoustic lens 18 is placed of a material in which the acoustic velocity is higher than in the liquid. A plano-concave lens form produces a converging beam, and with an appropriate radius of curvature for the lens, the beam can be given a constant energy density over its working length.

As an example of an experiment employing the invention, an acoustic plano-concave lens made from polystyrene having a density of 1.09 gms/cm$^2$, a modulus of elasticity at 23° C. of 17 $\times 10^3$ kg/cm$^2$ and a sonic velocity of approximately 2350 meters per second is used. The lens had a diameter of 15 mm, a thickness of 6 mm at the periphery and an accurately co-axial concave surface of 620 mm radius of curvature.

The plane surface of the lens was placed in contact with the plane surface of a 15 mm diameter barium titanate ceramic transducer having a resonant frequency of 4.4 MHz. The assembly was placed in water and the ultrasonic beam scanned along and across its axis using a Versiscan ultrasonic non-destructive testing scanning system. (Staveley, N.D.T. Technologies, Slough, England).

A long focal zone was observed about 500 mm from the source. The transducer and acoustic lens were mounted on a horizontal axis at one end of a water-filled trough, and an ultrasound absorbing carpet was placed at the opposite end of the trough.

The path of the ultrasound was observed through the transparent methyl methacrylate sides of the trough while very small crystals of potassium permanganate were allowed to fall through the water at or near the acoustic axis, in the area of the focal zone. The coloured trails of dissolved permanganate so formed indicated the stability of the water in that region.

At positions on the edge of the focal zone near the source, streaming was observed directed towards the source, while when remote from the source, streaming was observed away from the source. When the lens was removed, much more intense streaming was observed in a direction way from the source and at all positions along the axis of the beam.

It is also possible employ to the invention when a standing wave is produced using the transmission from a single source by interference with a coaxial reflection of that transmission.

It may be noted that even in regions where the transmission from one ultrasonic source does not overlap the transmission from the other, although outside the standing wave, there will be no acoustic streaming if the acoustic energy density is kept constant since no radiation pressure then acts on the fluid itself.

I claim:

1. A method of generating an ultrasonic energy field in an enclosed space filled with a fluid medium, comprising the steps of:

disposing an ultrasonic energy source at a spacing from said enclosed space;

directing a converging ultrasonic energy beam from said source along an axis of propagation extending through said enclosed space; and converging said beam from the source through the fluid medium at an angle sufficiently great such that the beam has a cross-sectional area throughout the enclosed space to at least substantially compensate for attenuation of ultrasonic energy in the fluid medium through at least substantially the whole of said enclosed space such that a substantially uniform energy density is created in the said enclosed space.

2. A method according to claim 1 wherein the ultrasonic energy output from the source is in the MHz range, up to about 25 MHz.

3. A method according to claim 1 wherein the beam is given an additional convergence to compensate for divergence of the source output.

4. A method according to claim 1 wherein a standing wave is formed in the ultrasonic field created by the source output.

5. Apparatus according to claim 9 wherein the output from said source is in the MHz range, up to about 25 MHz.

6. Apparatus according to claim 9 wherein the acoustic energy source has a concave emitting surface producing said convergence.

7. Apparatus according to claim 9 wherein lens means is placed in front of the acoustic energy source to produce said convergence.

8. Apparatus according to claim 9 further comprising a pair of sources producing a standing wave by interference of their fields in a region in which the attenuation of both sources is compensated.

9. Apparatus for generating an acoustic energy field in a volume of fluid, comprising:

an acoustic energy source for outputting a convergent acoustic energy beam along an axis of propagation;

a container for said volume of fluid, said container being spaced from said source along said axis of propagation such that the beam from said source generates the acoustic energy field in said container; and means for converging the beam from said source so as to form a convergent beam having an angle of convergence sufficiently great to at least substantially compensate for attenuation of acoustic energy along the axis of propagation of said beam, said convergent beam occupying and creating a substantially uniform energy density over the entire cross-section of said container in the direction of the axis of propagation over at least a substantial part of the length of said container.

10. A method of rendering more uniform the energy density of an ultrasonic standing wave in a fluid medium contained in an enclosed space, comprising the steps of:

disposing respective ultrasonic sources at a distance from said enclosed space; and propagating from said sources converging ultrasonic energy beams that intersect within said enclosed space to form the standing wave, said beams being given an angle of convergence sufficiently great to at least substantially compensate for attenuation of ultrasonic energy in the fluid medium, whereby the standing wave over at least a substantial part of the length of the enclosed space has a substantially uniform energy density over the entire cross-section of said enclosed space in a direction transverse to the standing wave.

11. A method according to claim 10, wherein the ultrasonic energy outputs from the sources are in the MHz range, up to about 25 MHz.

12. A method according to claim 10, wherein the beams are given an additional convergence to compensate for divergence of the outputs of the sources.

* * * * *